US006041604A

United States Patent [19]

Nicodemus

[11] Patent Number: 6,041,604

[45] Date of Patent: Mar. 28, 2000

[54] RANKINE CYCLE AND WORKING FLUID THEREFOR

[75] Inventor: Mark Nicodemus, Leroy, N.Y.

[73] Assignee: Helios Research Corporation, Mumford, N.Y.

[21] Appl. No.: 09/115,347

[22] Filed: Jul. 14, 1998

[51] Int. Cl.[7] ..... F01K 25/00

[52] U.S. Cl. ..... 60/671; 60/657

[58] Field of Search ..... 60/651, 671, 657

[56] References Cited

U.S. PATENT DOCUMENTS

| | | | |
|---|---|---|---|
| 4,424,677 | 1/1984 | Lukasavage | 60/671 |
| 4,558,228 | 12/1985 | Larjola | 60/657 |
| 4,961,311 | 10/1990 | Pave et al. | 60/657 |
| 5,490,386 | 2/1996 | Keller et al. | 60/657 |

*Primary Examiner*—Noah P. Kamen

*Attorney, Agent, or Firm*—Robert J. Bird

[57] ABSTRACT

A thermodynamic cycle for converting thermal energy of a working fluid to mechanical energy in a cycle of evaporation, expansion, condensation, and compression, includes methylene chloride as the working fluid. A system for performing the cycle includes a heat recovery boiler; an engine; a condenser; an open deaerating heater to receive condensate from the condenser; a heat exchanger to receive working fluid from the deaerating heater and condensate from the condenser en route to the deaerating heater; a boiler feed pump to receive working fluid from the heat exchanger and return it to the boiler; and a recuperative feed heater between engine and condenser to receive vapor from the engine and working fluid from the boiler feed pump en route to the boiler. The temperature differential between working fluid and heat source is at its minimum where working fluid enters the economizer section of the boiler and the waste heat medium leaves the economizer. The mass flow rate ratio of working fluid to waste heat medium is in the range from 0.5 to >1.

3 Claims, 4 Drawing Sheets

RANKINE CYCLE AND WORKING FLUID THEREFOR

BACKGROUND OF THE INVENTION

This invention relates to thermodynamic cycles, and more particularly to a working fluid for use in a Rankine cycle.

The Rankine cycle is the standard thermodynamic cycle in general use for electric power generation. The essential elements of a Rankine cycle system are: 1) a boiler to change liquid to vapor at high pressure; 2) a turbine to expand the vapor to derive mechanical energy; 3) a condenser to change low pressure exhaust vapor from the turbine to low pressure liquid; and 4) a pump to move condensate liquid back to the boiler at high pressure.

Water (steam) is the standard Rankine cycle working fluid. Water has many practical advantages. It is abundantly available, it is non-toxic, and generally non-corrosive. However, the thermodynamic properties of water are not the most ideal. A working fluid with more suitable thermodynamic properties, to increase the efficiency of a Rankine cycle, is desired and is an object of this invention.

Various other working fluids have been tried, but water remains the standard.

Prior art that I know of is as follows:

U.S. Pat. No. 4,896,509 to Tamura et al discloses a vapor cycle working fluid of 1,2-dichloro-1,1,2-trifluorethane.

U.S. Pat. No. 4,876,855 discloses vapor cycle working fluids including heptane, perfluorohexane, 1—1 dimethyl cyclohexane, and undecane.

U.S. Pat. No. 4,557,851 to Enjo et al discloses a vapor cycle working fluid of mixtures of trichlorofluoromethane and one of the group: difluoroethane, isobutane, and octafluorocyclobutane.

U.S. Pat. No. 4,530,773 to Enjo et al discloses a vapor cycle working fluid of a mixture of dichlorotetrafluoroethane and difluoroethane.

U.S. Pat. No. 4,465,610 to Enjo et al discloses vapor cycle working fluids of mixtures of pentafluoropropanol and water.

U.S. Pat. No. 4,224,795 discloses a vapor cycle working fluid of monochlorotetrafluoroethane.

U.S. Pat. No. 4,008,573 to Petrillo discloses a vapor cycle working fluid of trifluoroethanol.

U.S. Pat. No. 3,802,185 to Tulloch discloses a vapor cycle working fluid of 1,2,4-trichlorobenzene.

U.S. Pat. No. 3,753,345 discloses a vapor cycle working fluid of a mixture of hexafluorobenzene and perfluorotoluene.

U.S. Pat. No. 3,702,534 to Bechtold discloses a vapor cycle working fluid of perhalogenated benzenes of the formula $C_6\ Br_x\ Cl_y\ F_z$.

SUMMARY OF THE INVENTION

According to this invention, a Rankine cycle thermodynamic cycle for converting thermal energy of a working fluid to mechanical energy in a cycle of evaporation, expansion, condensation, and compression, includes methylene chloride as the working fluid.

A system for performing the cycle of this invention includes a heat recovery boiler, an engine, a condenser, an open deaerating heater to receive condensate from the condenser, a heat exchanger to receive working fluid from the deaerating heater and condensate from the condenser en route to the deaerating heater, a boiler feed pump to receive working fluid from the heat exchanger and return it to the boiler, and a recuperative feed heater between engine and condenser to receive vapor from the engine and working fluid from the boiler feed pump en route to the boiler. The temperature differential between working fluid and heat source is at its minimum where working fluid enters the economizer section of the boiler and the waste heat medium leaves the economizer. The mass flow rate ratio of working fluid to waste heat medium is in the range from 0.5 to >1.

DRAWING

DETAILED DESCRIPTION

Figure 1:
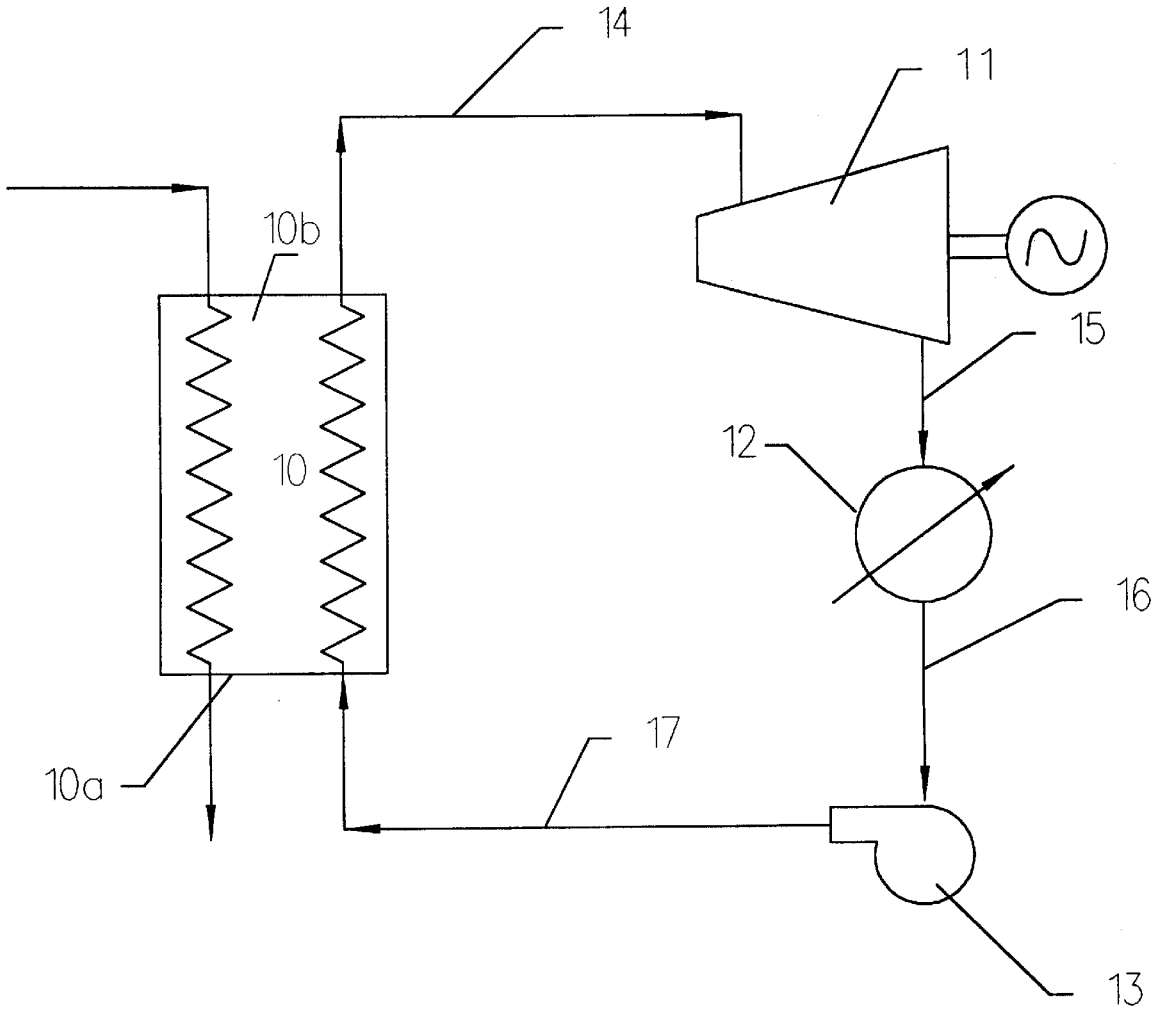
FIG. 1 is a flow diagram of a basic Rankine vapor cycle.

FIG. 1 represents a system for performing a Rankine cycle. It includes a boiler 10, a turbine 11, a vapor condenser 12, and a condensate or boiler feed pump 13, all connected in series by appropriate piping 14, 15, 16, 17. The boiler 10 includes an economizer section 10*a* at its feed inlet side, an evaporator section, and a superheater section 10*b* at its vapor outlet side.

A working fluid is evaporated at high pressure in the boiler 10. The high pressure vapor is then expanded in the turbine 11 to produce mechanical work. Exhaust vapor from the turbine, now at low pressure, is condensed to liquid in the condenser 12. Low pressure condensate from the condenser 12 is pumped back to the boiler 10 at high pressure by the boiler feed pump 13. Heat is supplied to the boiler from a heat source such as combustion, nuclear reaction, or other known source. Heat of condensation is removed from the condenser to a cold reservoir such as a body of water.

Factors in the choice of any alternative working fluid include: Safety (nonflammability, low toxicity); Environmental Compatibility; Availability (cost production capability); Non-Corrosiveness (compatibility with commonly used materials); Physical Properties (specific heats of liquid and vapor, heat of vaporization, normal boiling point, molecular weight, entropy, enthalpy, density of liquid and vapor, freezing point, vapor pressure, critical point).

I have examined the properties of methylene chloride. Methylene chloride (or dichloromethane, $C\ H_2\ Cl_2$) has heretofore been used primarily as a refrigerant or as a solvent, paint remover, or thinner. I have found it a desirable working fluid for a Rankine cycle. Methylene chloride satisfies virtually all of the above requirements. It has the potential to provide a more thermally efficient cycle than most organic fluids, binary mixture systems, or water, and its unique set of physical properties should permit the use of smaller less expensive system components without penalty.

A combined cycle is a combination of cycles operating at different temperatures, each of which cycles is otherwise independent of the other. The cycle operating at the higher temperature is called a topping cycle. The cycle operating at the lower temperature is called a bottoming cycle. The topping cycle rejects heat at high enough temperature to drive the bottoming cycle. The rejected heat is recovered in a waste heat recovery boiler to provide vapor for the bottoming cycle. A typical combined cycle system includes a gas turbine cycle producing a base load, and a Rankine cycle using exhaust gas from the gas turbine as its heat source. The exhaust gas provides a portion of its available energy to the Rankine cycle. The efficiency of the combined cycle system is greater than that of the gas turbine cycle alone.

The maximum energy available from the exhaust gas is the mechanical energy that could be taken from the gas when it is cooled to the ambient temperature. This maximum available energy is expressed as:

$$\text{Available Energy}=C_p(T-T_O)-T_O C_p \ln(T/T_O)$$

where:

$C_p$ is specific heat of exhaust gas at constant pressure;

T is exhaust gas temperature; and $T_O$ is ambient or sink temperature.

The above equation represents 100% of work obtainable (or available energy) from the exhaust gas.

Second law efficiency of the bottoming cycle is the ratio of actual work output to available energy, or:

Second law eff.=Work output/Available energy

As an example for analysis, consider a system in which turbine exhaust is at 1000° F., gas flow rate is 100,000 lb/hr, and the cooling sink is at 55° F. If the stream of hot gas of 0.25 Btu/lb/° F. constant thermal capacity is taken to flow without friction, and is cooled to sink temperature at constant composition, it is found that the maximum mechanical power that can be taken from the stream is 2.99 megawatts (102 Btu/lb of gas) This amount is 100% of the availability of the exhaust gas. It has been reported in the literature that, under these same boundary conditions, the maximum efficiency presently achievable in the Rankine bottoming cycle, in which water is the bottoming cycle working fluid, is 58.2%. That means that 58.2% of available energy in the turbine exhaust gas is the maximum amount recoverable as work. This determination is made by "second law" analysis, described in this and the preceding paragraph.

Figure 2:
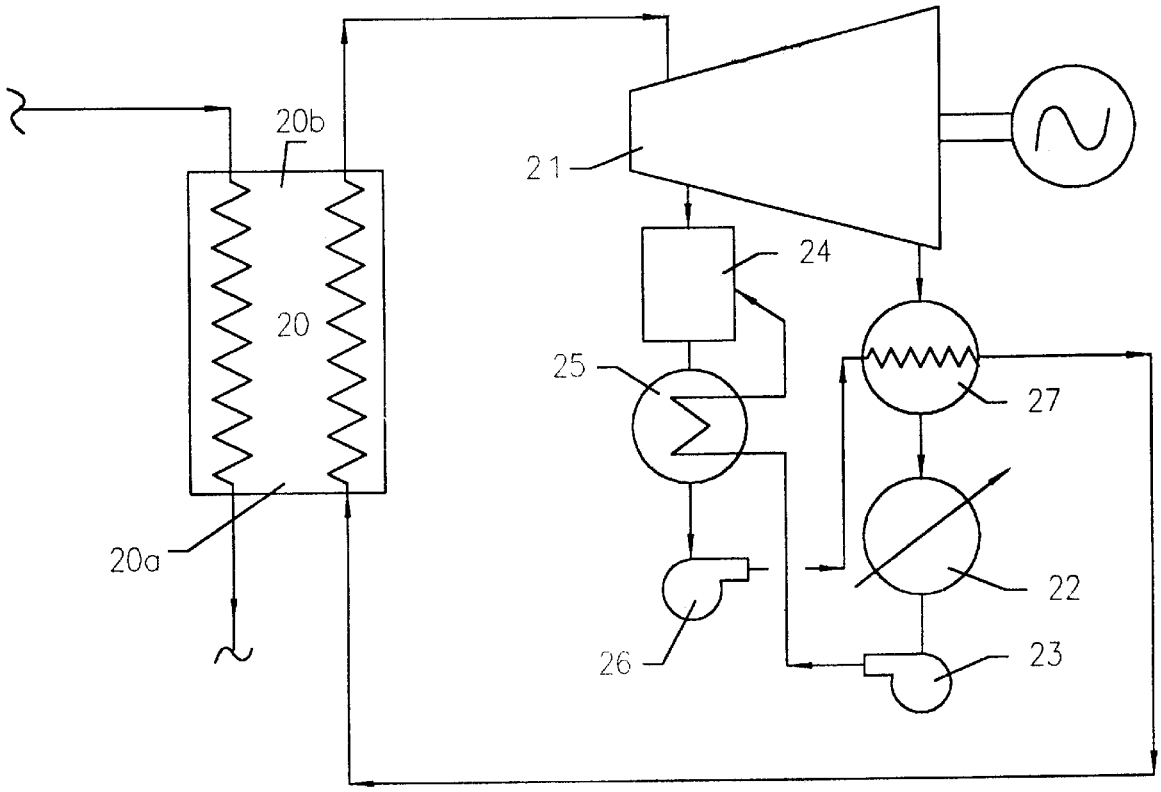
FIG. 2 is a diagram of the vapor or bottoming side of a combined gas and vapor cycle according to this invention.

FIG. 2 represents the bottoming cycle of a combined gas and Rankine cycle system, according to this invention. It includes a waste heat recovery boiler 20, a turbine 21, a vapor condenser 22, and a condensate pump 23, all connected in series by appropriate piping. The boiler 20 includes an economizer section 20*a* at its feed inlet side, an evaporator section, and a superheater section 20*b* at its vapor outlet side. The primary path of working fluid is from boiler 20 to turbine 21, to condenser 22, and ultimately back to the boiler.

Condensate from the condenser 22 moves from the condensate pump 23 into a deaerating heater 24. A portion of working fluid vapor may also be extracted from an intermediate stage of the turbine 21 into the deaerating heater 24 to combine there with condensate. The condensate and extracted vapor, if any (now liquid), flows from the deaerating heater 24 through a heat exchanger 25 and into a boiler feed pump 26.

Relatively cool condensate from the condenser 22 and pump 23 flows into the deaerator 24 by way of the heat exchanger 25 where it takes heat from the deaerator discharge, subcooling the deaerator discharge for intake to the boiler feed pump 26, and preheating the condensate on its way to the deaerator. The boiler feed pump 26 then pumps deaerated subcooled liquid back through a recuperative feed heater 27 between turbine 21 and condenser 22 to recover heat from the turbine exhaust vapor, and back to the boiler 20.

Exhaust gas from a gas turbine topping cycle is the heat source for the waste heat recovery boiler 20.

Subcooling the liquid intake to the boiler feed pump 26, by means of the heat exchanger 25, prevents flashing of the liquid and resulting cavitation in the pump. It also avoids the need to elevate the deaerating heater 24. (In typical prior art systems, the deaerating heater is elevated one or more stories to provide positive suction head to the boiler feed pump.) Thus, my system is an improvement for a power plant in terms of capital cost savings, construction, and space requirements. This improved plant design and configuration is not practical or advantageous, however, except with my cycle which uses a working fluid such as methylene chloride.

The working fluid in the bottoming cycle of FIG. 2 is methylene chloride, as in the cycle of FIG. 1. In a conventional steam cycle, or combined cycle, steam expands to a vacuum pressure and a temperature of, say, 90° F. By comparison, methylene chloride expands to a vacuum pressure, but at a temperature which is still relatively high, say 280° F. In other words, although methylene chloride in this state is fully expanded and has given up its mechanical energy, it is still hot and a significant amount of heat is wasted if that spent vapor were to be condensed directly as it leaves the turbine. Between the turbine and condenser, there is recoverable sensible heat remaining in the methylene chloride.

As was stated earlier, the intake to the boiler feed pump 26 is cooled somewhat to prevent flashing and cavitation. The hot methylene chloride exhaust from the turbine provides a source of recoverable heat to preheat the boiler feed from the pump 26. Accordingly, boiler feed from the pump 26, on its way to the boiler 20, first passes through a recuperative feed heater 27 between turbine 21 and condenser 22 to recover heat from the otherwise spent vapor.

Figure 3:
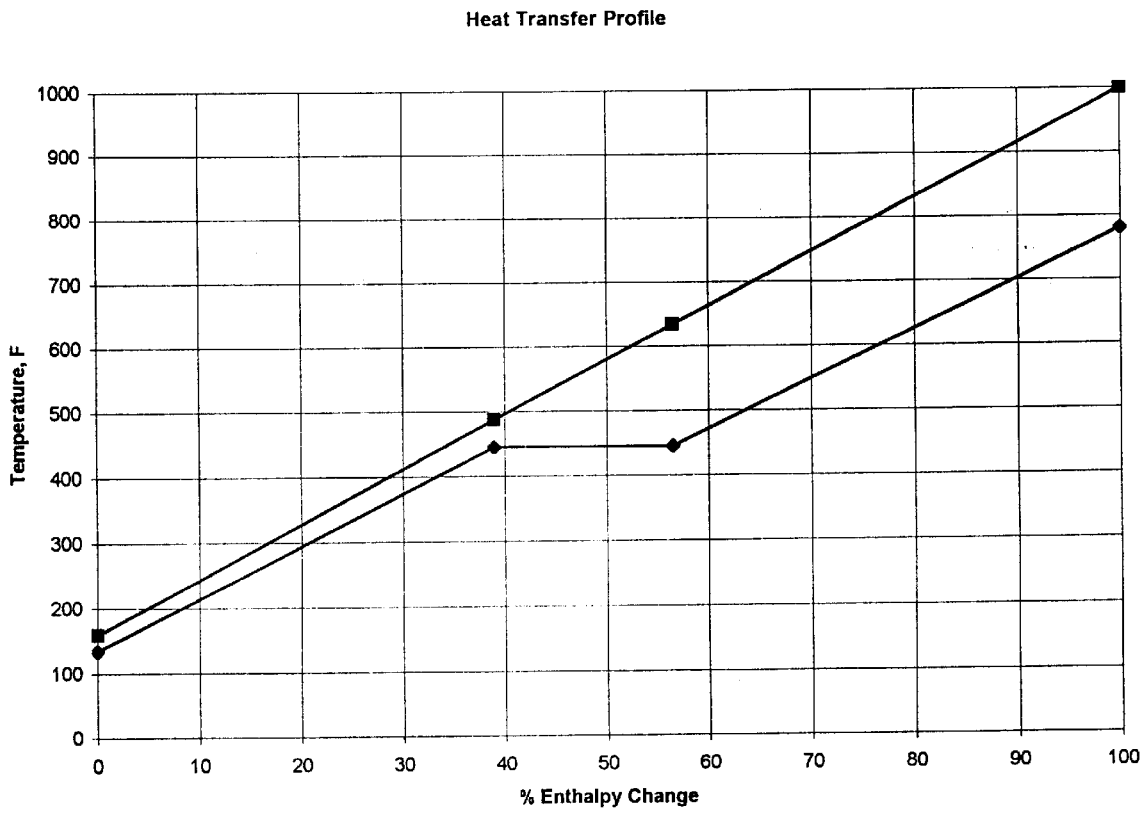
FIG. 3 is a temperature profile relating to the system of FIG. 2.

FIG. 3 is an example of a temperature profile relating to the bottoming cycle of FIG. 2. The upper curve (right to left) represents the decreasing temperature of exhaust gas or waste heat as it moves through the waste heat recovery boiler. The lower curve (left to right) represents the increasing temperature of working fluid as it moves through the waste heat recovery boiler. Waste heat enters the boiler (superheater end) at about 1000° F., and leaves the boiler (economizer end) at about 159° F. Working fluid enters the boiler as liquid at about 134° F., and leaves the boiler as vapor at about 800° F.

As seen in FIG. 3, the ascending temperature profile of the working fluid follows very closely the descending temperature profile of the waste heat. Indeed, the slopes of the two curves are substantially identical for both liquid and superheated vapor phases of the working fluid. Note also the relatively short horizontal (vaporizing) portion of the curve. This close match of the two profiles is most striking in the lower left, showing a very close coordination of waste heat given up and received as sensible heat in the working fluid. This lower left portion of the curves represents the economizer section of the boiler, which is normally the most inefficient area of heat transfer, i.e. greatest degree of entropy generation.

Figure 4:
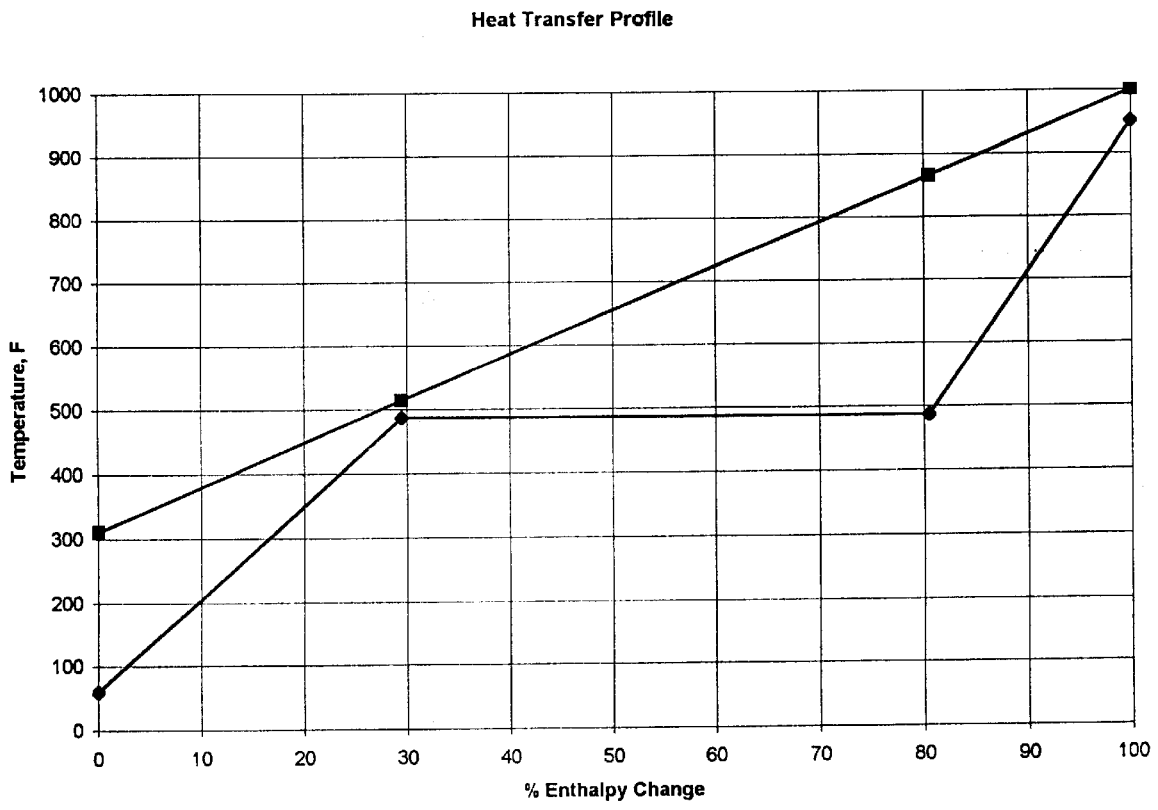
FIG. 4 is a comparable temperature profile of a water/steam system.

The area or space between upper and lower curves represents lost work. This area for a methylene chloride system (FIG. 3) is smaller than that of comparable curves (FIG. 4) representing a conventional water/steam system. This translates directly to greater efficiency in this system in which methylene chloride is the working fluid.

In a typical bottoming cycle of a conventional combined gas and steam cycle system, the mass flow rate ratio of working fluid to gas in the heat recovery boiler is typically in the range of 0.12 to 0.15. In other words, every pound of gas through the boiler generates only about 0.12 pounds to 0.15 pounds of stream. In the system of this invention, the mass flow rate ratio is in a range from 0.5 to more than 1.0. In other words, every pound of gas through the boiler generates from 0.5 pounds to more than one pound of vapor.

Methylene chloride can be used as the working fluid in: 1) the bottoming cycle in combined cycle systems, single or multi-pressure; 2) direct fired fossil fuel systems; 3) geothermal or other low temperature cycles; 4) any system where cooling towers are used, where cooling water to the condenser may be warmer than a typical cold reservoir.

It must be understood that in some situations it may be desirable to add stabilizers to methylene chloride under certain operating conditions, such as under high temperatures (compounds such as nitroalkane, alkylene oxide, and others have proven to offer benefits to methylene chloride in some of its other uses). Nevertheless, the working fluid I propose is materially and substantially methylene chloride, with or without stabilizers or additives.

The foregoing description of a preferred embodiment of this invention, including any dimensions, angles, or proportions, is intended as illustrative. The concept and scope of the invention are limited only by the following claims and equivalents thereof.

What is claimed is:

1. A combined cycle thermodynamic system for transferring heat from the exhaust gas of a gas turbine topping cycle to a working fluid, and converting said heat to mechanical energy in a bottoming Rankine cycle, said system including, in a closed cycle forming a working fluid path:

a boiler with economizer and vaporizer sections to transfer heat from said exhaust gas to said working fluid;

means to convey said exhaust gas at a mass flow rate FHM in a first direction through said vaporizer and economizer sections of said boiler;

means to convey said working fluid at a mass flow rate WF along said working fluid path, counter to said first direction, through said economizer and vaporizer sections of said boiler to heat said working fluid in said economizer section and vaporize said working fluid in said vaporizer section;

a heat engine to expand said vaporized working fluid and convert thermal energy thereof to mechanical energy;

a condenser to condense said working fluid;

a condensate pump to recirculate said condensed working fluid back to said boiler;

an open deaerating heater disposed to receive working fluid condensate from said condenser, a heat exchanger disposed to receive said working fluid from said deaerating heater and working fluid condensate from said condenser en route to said deaerating heater, and a boiler feed pump disposed to receive working fluid from said heat exchanger and return it to said boiler, whereby working fluid intake to said boiler feed pump is deaerated and subcooled liquid;

a recuperative feed heater disposed between said engine and said condenser to receive working fluid exhaust vapor from said engine, and to receive liquid working fluid from said boiler feed pump en route to said boiler;

the ratio of mass flow rate WF of said working fluid to mass flow rate FHM of said exhaust gas being in the range from 0.5 to >1, whereby the temperature differential between said exhaust gas and said working fluid is at minimum where said working fluid enters said economizer section and said exhaust gas leaves said economizer section;

said working fluid possessing peculiar thermophysical properties such that upon leaving said boiler it is thermodynamically capable, in an ideal isentropic expansion process, of yielding a total isentropic enthalpy drop of 75% or more of the available energy of said fluid heat medium as determined by second-law analysis.

2. A thermodynamic system as defined in claim 1, said deaerating heater being disposed also to receive working fluid vapor extracted from said engine.

3. A thermodynamic system as defined in claim 1, wherein said working fluid is substantially methylene chloride.

* * * * *